US009844712B1

(12) United States Patent
Carter, Sr.

(10) Patent No.: US 9,844,712 B1
(45) Date of Patent: Dec. 19, 2017

(54) BALL TOSS AND RETRIEVAL TOY IN THE SHAPE OF A SOFTBALL BAT

(71) Applicant: Ronald Dale Carter, Sr., Lynn Haven, FL (US)

(72) Inventor: Ronald Dale Carter, Sr., Lynn Haven, FL (US)

( * ) Notice: Subject to any disclaimer, the term of this patent is extended or adjusted under 35 U.S.C. 154(b) by 0 days.

(21) Appl. No.: 15/611,007

(22) Filed: Jun. 1, 2017

(51) Int. Cl.
*A63B 69/40* (2006.01)
*A63B 67/22* (2006.01)
*A63H 33/18* (2006.01)

(52) U.S. Cl.
CPC ..... *A63B 67/22* (2013.01); *A63H 33/18* (2013.01)

(58) Field of Classification Search
USPC ..... 473/138, 231, 307, 409, 425, 457, 507, 473/566
See application file for complete search history.

(56) References Cited

U.S. PATENT DOCUMENTS 3,120,387 A * 2/1964 Weinstein ..... A63B 60/38 124/64
3,376,037 A * 4/1968 Lepselter ..... A63B 67/20 273/330
4,384,719 A 5/1983 Schmanski
4,526,374 A * 7/1985 Ban ..... A63B 69/0079 473/231
4,733,868 A * 3/1988 Seiden ..... A63B 67/20 242/225
4,784,389 A * 11/1988 Taylor ..... A63B 67/20 473/425
5,024,435 A * 6/1991 Robbins ..... A63B 65/122 473/457
5,071,123 A * 12/1991 Spector ..... A63B 60/38 446/76
5,467,740 A * 11/1995 Redwine ..... A01K 15/025 119/707
5,522,372 A * 6/1996 Gerstikov ..... A63B 59/20 124/5
5,700,202 A * 12/1997 Tucker ..... A63B 69/0079 473/142
6,032,894 A * 3/2000 Chapman ..... A01K 89/015 242/310
8,579,222 B1 * 11/2013 Alvarez ..... A01K 89/017 242/224
D755,314 S 5/2016 Williams
2002/0072436 A1 6/2002 Liu
2002/0137581 A1 9/2002 Wang
2003/0144065 A1 * 7/2003 Palmer ..... A01K 87/00 473/138
2015/0190699 A1 7/2015 Cruz

* cited by examiner

*Primary Examiner* — Nini Legesse
(74) *Attorney, Agent, or Firm* — Mitch Harris, Atty at Law, LLC; Andrew M. Harris

(57) ABSTRACT

A ball toss and retrieval toy provides for entertainment and exercise by children. The toy takes the form of a bat and has an open end for tossing the ball from the toy. The toy also has a cord and reel mechanism that attaches the ball to the bat, allowing for retrieval of the ball from a fixed position. The reel mechanism includes a release mechanism that allows the cord to play out as the toy is operated in a toss operation similar to a fishing casting operation. The ball can then be reeled in by the reel mechanism, which may include a mechanical crank or may be motorized.

17 Claims, 6 Drawing Sheets

BALL TOSS AND RETRIEVAL TOY IN THE SHAPE OF A SOFTBALL BAT

BACKGROUND OF THE INVENTION

1. Field of the Invention

The present invention relates generally to sporting/outdoor equipment, and in particular, a toy that provides for tossing and retrieving a ball from a fixed position.

2. Description of the Related Art

Toys in the form of sporting/outdoor equipment, e.g., toy football, baseball, fishing, hunting, bowling equipment, etc., are in common use to provide entertainment and exercise for children. New forms of such toys are typically desirable, both for their novelty and for increasing the selection of toys that parents and children will want to buy and use.

Therefore, it would be desirable to provide another form of toy for entertainment and exercise.

SUMMARY OF THE INVENTION

The objective of providing a toy for entertainment and exercise is accomplished in a ball toss and retrieval toy that includes a ball and a toy body. The toy body is hollow and has a substantially cylindrical handle portion, a substantially cylindrical end portion having a diameter larger than the diameter of the handle portion and a tapered portion extending between them. The inner diameter of the end portion, which is open, is greater than an outer diameter of the ball. The tapered portion has an inner diameter such that the ball can be seated at least partially within the tapered portion of the hollow toy body when the ball is inserted in the open end of the end portion. The toy also includes a cord connected to the ball and a reel device having a spool around which the cord is wound when the ball is in the toy. The reel device also has a release mechanism, so that when the release mechanism is activated with the ball positioned in the hollow toy body, the hollow toy body can be swung downward to toss the ball out from and away from the hollow toy body. The reel device further includes a retrieval mechanism for winding the cord around the spool to retrieve the ball so that the ball is seated at least partially within the tapered portion of the hollow toy body.

The foregoing and other objectives, features, and advantages of the invention will be apparent from the following, more particular, description of the preferred embodiment of the invention, as illustrated in the accompanying drawings.

BRIEF DESCRIPTION OF THE DRAWINGS

The novel features believed characteristic of the invention are set forth in the appended claims. The invention itself, however, as well as a preferred mode of use, further objectives, and advantages thereof, will best be understood by reference to the following detailed description of an illustrative embodiment when read in conjunction with the accompanying drawings, wherein like reference numerals indicate like components, and:

DESCRIPTION OF ILLUSTRATIVE EMBODIMENT

The present invention includes ball toss and retrieval toys and associated methods that provide for exercise and entertainment of children. The ball toss and retrieval toy includes a ball on a cord attached to a hollow toy body that may be in the form of a toy baseball bat with an open end. A reel device similar to a fishing reel is attached to or formed as part of the hollow toy body. The ball is placed inside the hollow body and a release button on the reel device is depressed as the hollow toy body is swung downward, simulating (and instructing) a casting operation as would be used in rod and reel fishing. The ball is allowed to fly to the extent of the cord, and is then retrieved by operating the reel device, which may be a hand-operated crank-type reel device, or a motorized retrieval device.

Figure 1B:
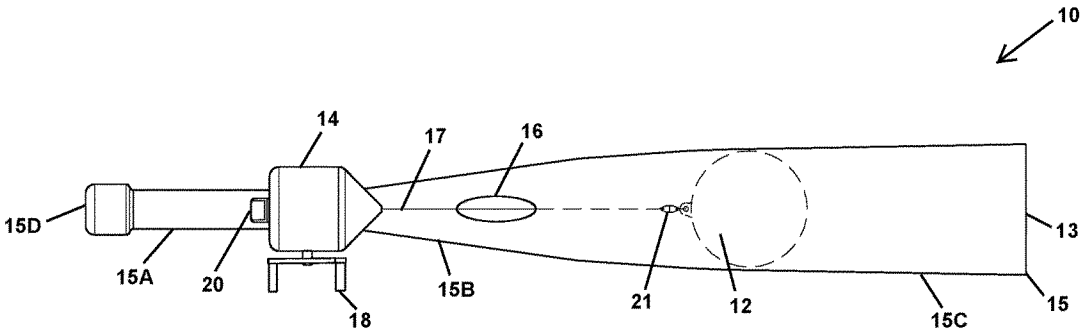
FIG. 1A is a top view and FIG. 1B is a side view, showing an example of a ball toss and retrieval toy 10 as disclosed herein.
Figure 1A:
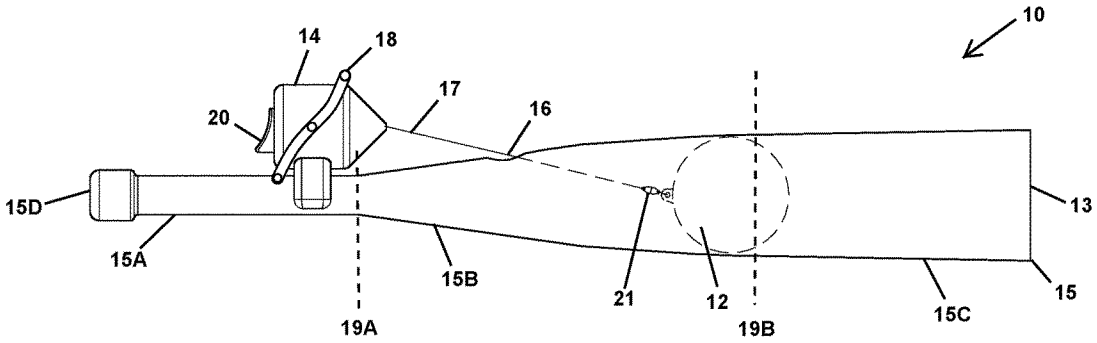

Referring now to FIG. 1A and FIG. 1B, an illustrative example of a ball toss and retrieval toy 10 is shown in a top view and a side view, respectively. Ball toss and retrieval toy 10 includes a ball 12, which is shown in a ready position inside of a hollow toy body 15 in the form of a toy baseball/softball bat and that includes a substantially cylindrical handle portion 15A (the portion to the left of line 19A in FIG. 1B) having an outer diameter of approximately one inch (1.0 in) and a hand stop 15D with a slightly greater outer diameter. Hollow toy body 15 also includes a substantially cylindrical end portion 15C (the portion of hollow toy body 15 to the right of line 19B in FIG. 1B) having a largest diameter of approximately three-and-a-quarter inches (3.25 in) and a tapered portion 15B (the portion of hollow toy body 15 between lines 19A and 19B) in FIG. 1B) that expands from the diameter of handle portion 15A to the diameter of end portion 15C. Ball 12 has a diameter of approximately two and seven-eighths of an inch (2.875 in), and the thickness of hollow toy body 15 is generally less than one-sixteenth of an inch (0.625 in), so that when ball 12 is inserted in an open end 13 of end portion 15C, ball 12 will rest at least partially within tapered portion 15B when the ball toss and retrieval toy 10 is held upright, i.e., with the open end of end portion 15C facing upward. Ball 12 is also retained in hollow toy body 15 prior to use by a cord 17 that extends from a reel 14 located near handle portion 15A, which may be mounted on hollow toy body 15, or alternatively have a housing formed contiguously with hollow toy body 15 or alternatively be located inside of hollow toy body 15 in some embodiments. Cord 17 is coupled to ball 12 by a swivel 21 that permits ball 12 to spin when being "cast" from hollow toy body 15 without twisting cord 17.

Figure 2:
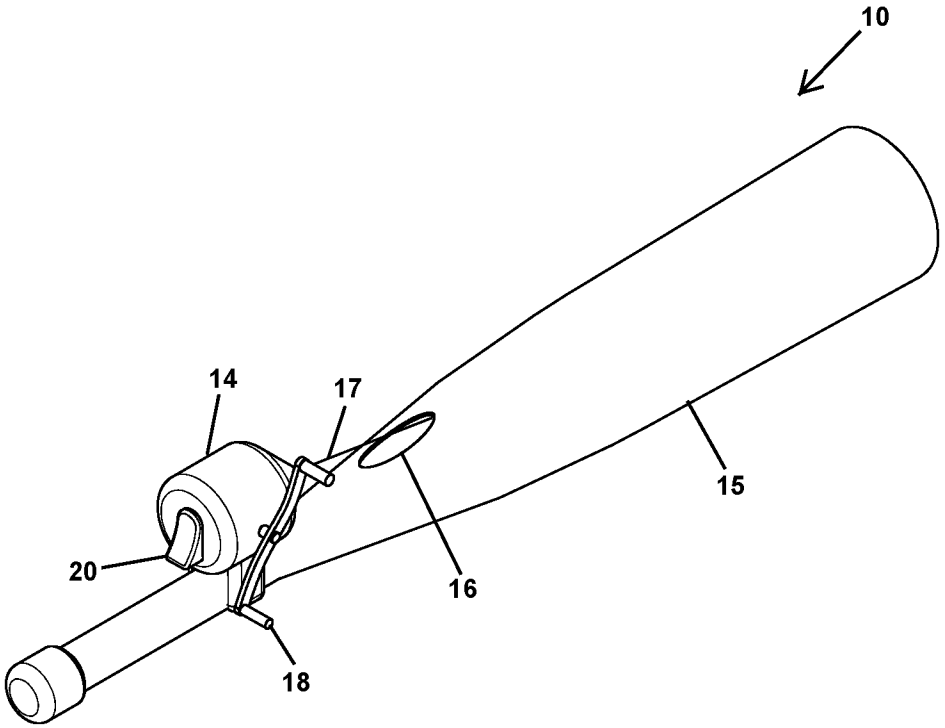
FIG. 2 is an isometric view showing details of ball toss and retrieval toy 10 of FIGS. 1A-1B.

Reel 14 is a mechanical reel device in the illustrated example, but may alternatively be an electrically-operated reel device as described below with reference to FIG. 5, and either type of reel device may be provided at an external surface of hollow toy body 15, or partially or completely integrated within hollow toy body 15, as long as the mechanism or button switches used to activate and release the reel device 14 are accessible by the user. Reel 14 includes a release button 20 used for "casting" ball 12 and a hand crank 18 used to retrieve ball 12. Cord 17, which may be a nylon cord or other suitable and durable cord attachment, passes through an aperture 16 that is provided through hollow toy body 15. Aperture 16 and may have an oval shape as depicted, so that lateral movement of cord 16 along the circumference of hollow toy body 15 is restricted more than lengthwise movement that changes the angle of cord 16 with respect to a cylindrical axis of hollow toy body 15. FIG. 2 shows a perspective view of ball toss and retrieval toy 10.

Figure 3:
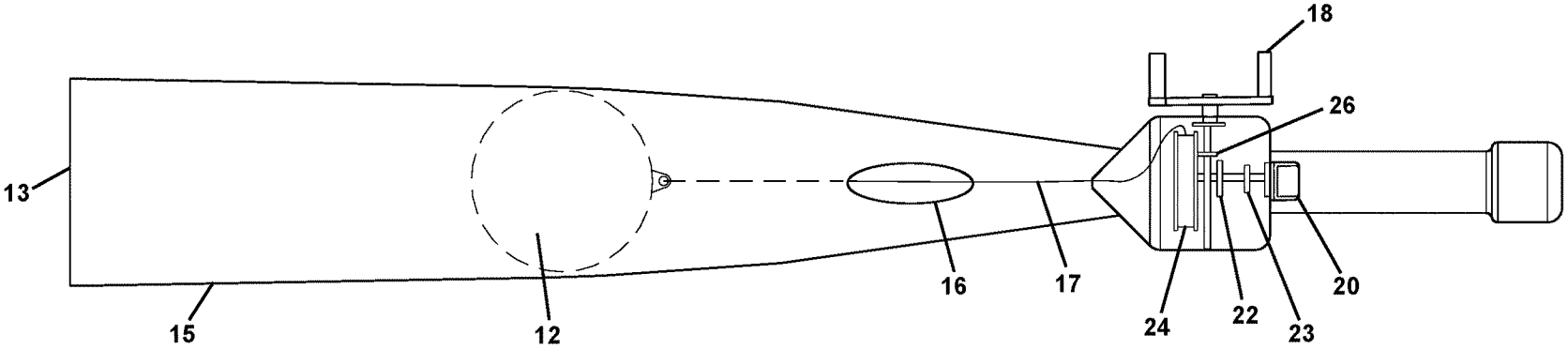
FIG. 3 is a top view showing further details within a reel 14 of ball toss and retrieval toy 10 in FIG. 1.

Referring now to FIG. 3, a top view of ball toss and retrieval toy 10 is shown, illustrating details of reel 14. Reel 14 includes a spool 24 around which cord 17 is wound when ball 12 is retrieved. Hand crank 18 operates a transmission 26 that causes rotation of an axle 23 that rotates spool 24 to wind cord 17 around spool 24. Transmission 26 is disengaged by release button 20, which operates a clutch 22 that operates by a threaded or geared connection to free spool 24 to rotate without rotating hand crank 18, until hand crank 18 is operated to reverse the rotation of spool 24, causing clutch 22 to engage and release button 20 to be restored to its original state, providing the ability to cast ball 12 again.

Figure 4B:
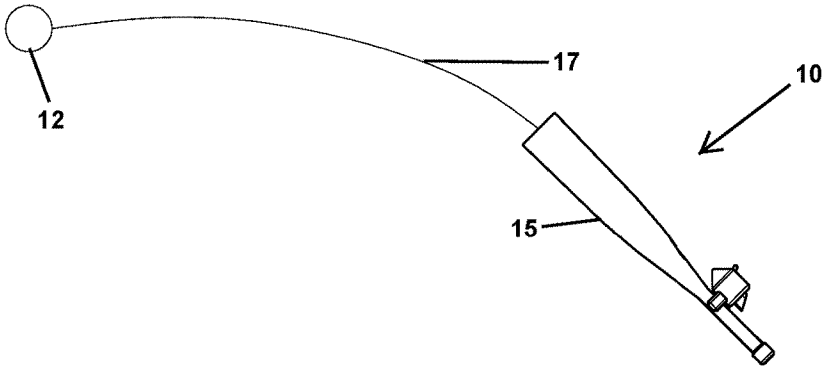
FIGS. 4A-4D are pictorial views showing a use of ball toss and retrieval toy 10 of FIGS. 1A-1B
Figure 4A:
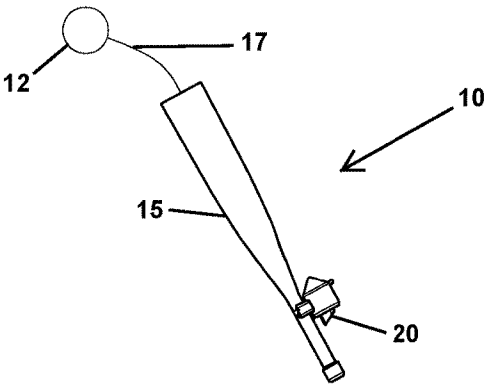
Figure 4D:
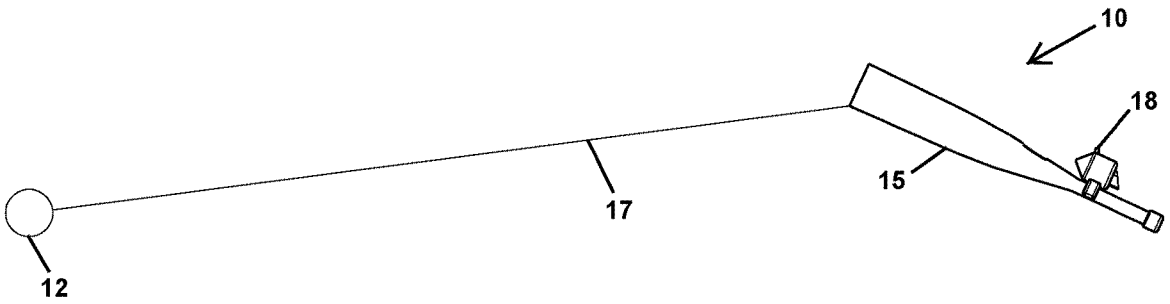
Figure 4C:
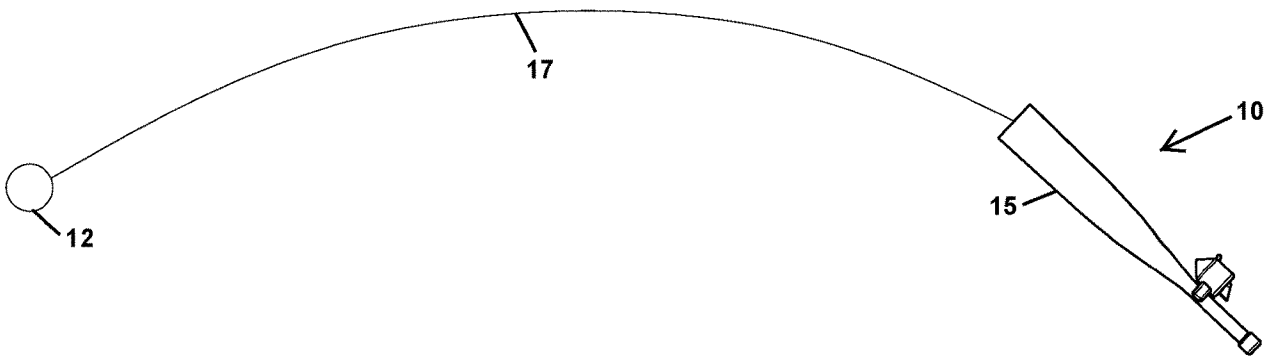

Referring to FIGS. 4A-4D, operation of ball toss and retrieval toy 10 is illustrated. FIG. 4A shows the initial casting position after release button 20 has been pressed as ball toss and retrieval toy 10 is swung downward, causing ball 12 and cord 17 to exit the open end of hollow toy body 15. In FIG. 4B, ball 12 continues to fly forward from the momentum delivered by snapping hollow toy body 15 downward and in FIG. 4C, cord 17 has just reached a maximum extent. In FIG. 4D, reel 14 is operated to tension cord 17 causing ball 12 to return toward hollow toy body 15, and eventually return ball 12 to again rest within hollow toy body 15, so that ball 12 can be cast again.

Figure 5:
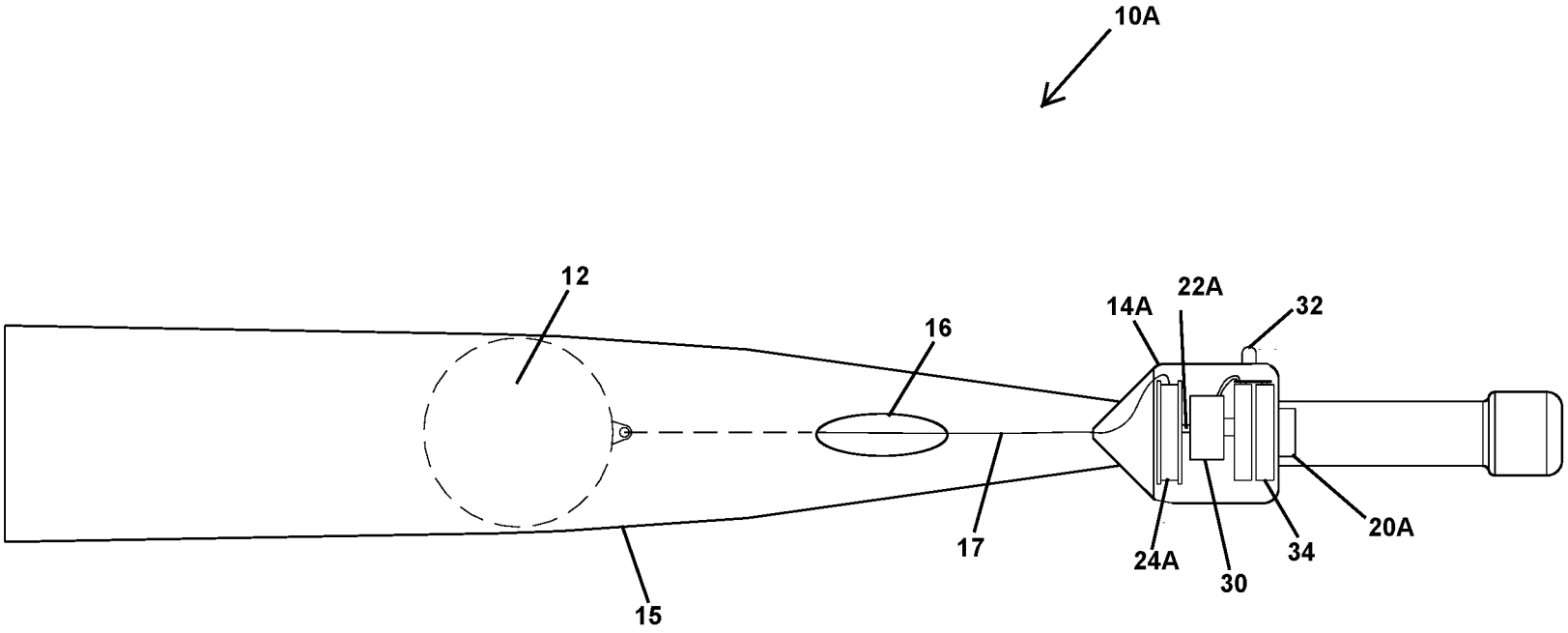
FIG. 5 is a top view showing further details within a reel 14A of a ball toss and retrieval toy 10A that may alternatively be used to implement ball toss and retrieval toy 10 of FIGS. 1A-1B.

Referring to FIG. 5, an alternative example of a ball toss and retrieval toy 10A is shown, which incorporates an electric reel device 14A. Other features of ball toss and retrieval toy 10A are identical to ball toss and retrieval toy 10 described above, so only differences between them will be described. Reel device 14A incorporates a spool 24A that is rotated by an electric motor 30 powered by one or more replaceable batteries secured in a battery holder 34. A motor activation button switch 32 is provided to close the circuit between the batteries and electric motor 30 to cause spool 24A to wind cord 17 around spool 24A. A release button 20A moves electric motor 30 to disengage a shaft 22A of motor 30 from spool 24A, providing a clutch that permits spool 24A to rotate freely, until electric motor 30 is activated by button switch 32 and rotates to re-engage with spool 24A, via a threaded or gearing arrangement that provide the clutch action.

While the invention has been particularly shown and described with reference to the preferred embodiment thereof, it will be understood by those skilled in the art that the foregoing and other changes in form, and details may be made therein without departing from the spirit and scope of the invention.

What is claimed is:

1. A toss and retrieval toy, comprising:

a ball;

a hollow toy body having a substantially cylindrical handle portion with a first outer diameter, a substantially cylindrical end portion having a second outer diameter larger than the first diameter and an inner diameter greater than an outer diameter of the ball and a tapered portion extending between the handle portion and the end portion having an inner diameter that tapers such that the ball can be seated at least partially within the tapered portion of the hollow toy body, wherein a terminal end of the end portion opposite the handle is open to define a first aperture to receive the ball;

a cord connected to the ball at a first end thereof; and a reel device integrated with the hollow toy body and having a spool for winding the cord from a second end of the cord, wherein the cord extends within the hollow toy body from the ball through a second aperture formed through the tapered portion of the hollow toy body and outside of the hollow toy body and to the reel device when the ball is seated at least partially within the tapered portion of the hollow toy body, wherein the reel device further has a release mechanism, whereby when the release mechanism is activated with the ball positioned in the hollow toy body, the hollow toy body can be swung downward to toss the ball out from and away from the hollow toy body, and wherein the reel device further includes a retrieval mechanism for winding the cord around the spool to retrieve the ball so that the ball is seated at least partially within the tapered portion of the hollow toy body.

2. The toss and retrieval toy of claim 1, wherein the second aperture has an oval shape to permit a first angle between the cord and a cylindrical axis of the end portion of the hollow toy body to change to a greater degree than a second angle between the cord and an output of the reel device where the cord exits the reel device.

3. The toss and retrieval toy of claim 1, wherein the hollow toy body is a molded plastic toy body and the ball is a hollow plastic ball, each having a thickness equal to or less than one-sixteenth of an inch.

4. The toss and retrieval toy of claim 1, wherein the retrieval mechanism includes a hand-operated crank.

5. The toss and retrieval toy of claim 1, wherein the retrieval mechanism comprises:

a battery holder for holding a battery;

a motor mechanically coupled to the spool; and a switch for activating the motor to retrieve the ball.

6. The toss and retrieval toy of claim 1, wherein the release mechanism comprises a clutch that permits the spool to turn freely independent of the retrieval mechanism to release the ball.

7. The toss and retrieval toy of claim 1, further comprising a swivel for coupling the first end of the cord to the ball, whereby the ball is permitted to rotate without twisting the cord when the ball is tossed and retrieved.

8. The toss and retrieval toy of claim 1, wherein the first outer diameter of the cylindrical handle portion is approximately one inch, the second outer diameter of the substantially cylindrical end portion is approximately three-and-a quarter inches and the outer diameter of the ball is approximately two and seven-eighths inches.

9. A toss and retrieval toy, comprising:

a ball;

a hollow toy body having a substantially cylindrical handle portion with a first outer diameter, a substantially cylindrical end portion having a second outer diameter larger than the first diameter and an inner diameter greater than an outer diameter of the ball and a tapered portion extending between the handle portion and the end portion having an inner diameter that tapers such that the ball can be seated at least partially within the tapered portion of the hollow toy body, wherein a terminal end of the end portion disposed opposite the handle is open to provide a first aperture to receive the ball;

a cord connected to the ball at a first end thereof; and a reel device connected to an outside surface of the hollow toy body proximate the handle portion, wherein the hollow toy body includes a second aperture through the tapered portion of the hollow toy body and through which the cord is passed, so that the cord extends from inside of the hollow toy body to the reel device outside of the hollow toy body through the second aperture to connect to the ball when the ball is at least partially seated within the tapered portion of the hollow toy body, wherein the reel device has a spool for winding the cord from a second end of the cord, and a hand-operated crank for causing the spool to rotate to wind the cord to retrieve the ball so that the ball is seated at least partially within the tapered portion of the hollow toy body, wherein the second aperture has an oval shape to permit a first angle between the cord and a cylindrical axis of the end portion of the hollow toy body to change to a greater degree than a second angle between the cord and an output of the reel device where the cord exits the reel device, wherein the reel device further has a release mechanism including a clutch that permits the spool to turn freely independent of the retrieval mechanism to release the ball, whereby when the release mechanism is activated with the ball positioned in the hollow toy body, the hollow toy body can be swung downward to toss the ball out from and away from the hollow toy body.

10. A method of providing a toy for ball toss and retrieval, the method comprising:

providing a ball;

providing a hollow toy body having a substantially cylindrical handle portion with a first outer diameter, a substantially cylindrical end portion having a second outer diameter larger than the first diameter and an inner diameter greater than an outer diameter of the ball and a tapered portion extending between the handle portion and the end portion having an inner diameter that tapers such that the ball can be seated at least partially within the tapered portion of the hollow toy body, wherein a terminal end of the end portion disposed opposite the handle is open to define a first aperture to receive the ball, and wherein the tapered portion defines a second aperture therethrough for passage of a cord;

providing a reel device integrated with the hollow toy body and having a spool for winding a cord from a second end of the cord and further having a release mechanism, wherein the reel device is positioned outside of the hollow toy body proximate the handle portion;

connecting the cord to the ball at a first end of the cord;

passing the cord inside the tapered portion of the hollow toy body and through the second aperture to the outside of the hollow toy body;

connecting a second end of the cord to the reel device outside of the hollow toy body, whereby when the release mechanism is activated with the ball positioned in the hollow toy body, the hollow toy body can be swung downward to toss the ball out from and away from the hollow toy body; and winding the cord around the spool with a retrieval mechanism of the reel device to retrieve the ball so that the ball is seated at least partially within the tapered portion of the hollow toy body.

11. The method of claim 10, wherein the providing a hollow toy body provides a hollow toy body with a second aperture that has an oval shape to permit a first angle between the cord and a cylindrical axis of the end portion of the hollow toy body to change to a greater degree than a second angle between the cord and an output of the reel device where the cord exits the reel device.

12. The method of claim 10, further comprising molding or extruding the hollow toy body and the ball from plastic materials, wherein the hollow toy body and the ball each have a thickness equal to or less than one-sixteenth of an inch.

13. The method of claim 10, wherein the winding the cord around the spool comprises operating a hand-operated crank.

14. The method of claim 10, wherein the winding the cord around the spool comprises activating a motorized battery-operated retrieval mechanism.

15. The method of claim 10 further comprising releasing the cord by de-activating a clutch of the release mechanism to permit the spool to turn freely independent of the retrieval mechanism to release the ball.

16. The method of claim 10, wherein the connecting the cord to the ball comprises connecting a swivel to the first end of the cord and to the ball, whereby the ball is permitted to rotate without twisting the cord when the ball is tossed and retrieved.

17. The method of claim 10, wherein the providing a hollow toy body provides a hollow toy body such that a first outer diameter of the cylindrical handle portion is approximately one inch, the second outer diameter of the substantially cylindrical end portion is approximately three-and-a quarter inches, and wherein the providing a ball provides a ball having an outer diameter of approximately two and seven-eighths inches.

* * * * *